US010801455B2

(12) United States Patent
Dylong et al.

(10) Patent No.: US 10,801,455 B2
(45) Date of Patent: Oct. 13, 2020

(54) FUEL INJECTION NOZZLE

(71) Applicant: Ford Global Technologies, LLC, Dearborn, MI (US)

(72) Inventors: Krystian Dylong, Cologne (DE); Bernd Steiner, Bergisch Gladbach (DE); Oliver Berkemeier, Bergisch Gladbach (DE); Robin Ivo Lawther, Chelmsford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 80 days.

(21) Appl. No.: 15/293,157

(22) Filed: Oct. 13, 2016

(65) Prior Publication Data

US 2017/0114765 A1 Apr. 27, 2017

(30) Foreign Application Priority Data

Oct. 21, 2015 (DE) ..... 10 2015 220 550

(51) Int. Cl.
*F02M 61/10* (2006.01)

(52) U.S. Cl.
CPC ..... *F02M 61/10* (2013.01); *F02M 2200/315* (2013.01)

(58) Field of Classification Search
CPC ..... F02M 61/10; F02M 61/20; F02M 61/161; F02M 61/163; F02M 61/162; F02M 61/1873; F02M 2200/315; F02M 2200/03
USPC .... 239/464, 466, 467, 533.12; 251/123, 126
See application file for complete search history.

(56) References Cited

U.S. PATENT DOCUMENTS 5,058,808 A * 10/1991 Young ..... B05B 1/323 239/464
5,845,621 A 12/1998 Robinson et al.
6,148,798 A 11/2000 Braun et al.
6,871,637 B2 3/2005 Tsuchiya et al.
6,901,913 B1 6/2005 Tsuchiya et al.
6,948,479 B1 9/2005 Raney et al.
2006/0102752 A1* 5/2006 Boecking ..... F02M 45/086 239/533.2

(Continued)

FOREIGN PATENT DOCUMENTS

DE 19942855 A1 3/2001
DE 10247775 A1 4/2004

(Continued)

OTHER PUBLICATIONS

National Intellectual Property Administration of the People's Republic of China, Office Action and Search Report Issued in Application No. 201610920482.1, dated Dec. 4, 2019, 9 pages. (Submitted with Partial Translation).

*Primary Examiner* — Tuongminh N Pham
(74) *Attorney, Agent, or Firm* — Geoffrey Brumbaugh; McCoy Russell LLP

(57) ABSTRACT

A high-pressure fuel injection system includes a nozzle housing and a nozzle needle that is axially displaceable in the nozzle housing and with which an outflow opening in a valve seat of the fuel injection nozzle can be closed and opened. At least one pulsation reducer is arranged between the nozzle needle and an inside of the nozzle housing. The pulsation reducer includes a plurality of breakwater elements that dampen pressure pulsations in the fuel flowing through the injection nozzle to the outflow opening.

20 Claims, 4 Drawing Sheets

(56) References Cited

U.S. PATENT DOCUMENTS

| | | | | |
|---|---|---|---|---|
| 2007/0063074 | A1* | 3/2007 | Mertens | F02M 45/086 239/533.2 |
| 2007/0108317 | A1* | 5/2007 | Boecking | F02M 45/086 239/533.12 |
| 2010/0314470 | A1* | 12/2010 | Cavanagh | B05B 1/3436 239/490 |
| 2013/0256429 | A1* | 10/2013 | Kobayashi | F02M 61/162 239/488 |

FOREIGN PATENT DOCUMENTS

| | | | |
|---|---|---|---|
| DE | 102011120945 | A1 | 6/2012 |
| DE | 102013213621 | A1 | 1/2015 |
| EP | 0886066 | A1 | 12/1998 |
| EP | 2110542 | A1 | 10/2009 |
| JP | H1182229 | A | 3/1999 |
| JP | 2002089402 | A | 3/2002 |

* cited by examiner

FUEL INJECTION NOZZLE

CROSS REFERENCE TO RELATED APPLICATIONS

This application claims priority to German Patent Application No. 102015220550.9, filed Oct. 21, 2015, the entire contents of which are hereby incorporated by reference for all purposes.

FIELD

The invention relates to a fuel injection nozzle for a high-pressure fuel injection system.

BACKGROUND

Many modern motor vehicles use injection engines, which require a high-pressure fuel injection system to supply fuel to the engine under pressure via a plurality of such injection nozzles. The injection nozzles may be electromagnetically operated injectors, for example, which supply fuel to the engine in metered cycles. Injection by the injection nozzles may be regulated by an electronic engine control system. Operation of such injection nozzles and of an associated fuel pump causes pressure pulsations and therefore vibrations in the fuel supply that may be transferred to a vehicle body, particularly when fuel supply lines of the high-pressure fuel injection system are rigid. This may lead to unwanted noise generation.

Other attempts to address noise generated while operating injector nozzles of a fuel system include use of dampening elements to reduce noise generation. One example approach is shown in U.S. Pat. No. 6,948,479 B1, which discloses a flexible hose element that can be used within a fuel supply system to dampen pressure pulsations in fuel lines. The hose element has a flexible damping element inside configured to dampen the pressure pulsations. The flexible damping element is a corrugated sheath and is preferably embedded in an elastic foam with which the hose element is filled.

In addition, a fuel supply system disclosed in U.S. Pat. No. 6,148,798 A has a fuel distribution pipe with a fuel supply line and a return line for surplus fuel. In this case, the fuel return line is conducted within the fuel supply line and therefore surrounded by a tubular damping element in such a manner as to dampen pressure pulsations. The damping element has a cross section for this purpose, which is not circular, but is oval or rectangular, for example. This should make the sidewalls of the damping tube flexible enough to be able to dampen pressure pulsations. EP 0 886 066 A1 also proposes a damping element within a fuel supply system. In this case, for example, damping elements are used at different positions within the fuel supply system or else components of the fuel supply system are configured in such a manner that they have a damping effect.

However, the inventors herein have recognized potential issues with such systems. As one example, pressure pulsations caused by the opening and closing of an injection nozzle and the fuel supply through a pump may not only generate unwanted noise, but also lead to problems during the injection process. During the injection process, pressure pulsations of ±20 bar may occur in a seat of the injection nozzle that may affect the amount of fuel injected. While some of the systems described above may reduce pressure pulsations enough to sufficiently reduce unwanted noise, the systems may not reduce the pressure pulsations to a large enough degree to reduce associated fueling errors. Some of the above-described damping elements are arranged along fuel lines, such as fuel supply line and/or fuel return line, which may not adequately reduce pressure pulsations at the nozzle seat and hence, may result in errors in volume of fuel injected by the fuel injector. This kind of injection error cannot be counterbalanced by a fuel control system. The inventors herein propose a fuel injection nozzle in which pressure pulsations, particularly in the region of the nozzle seat, are reduced.

In one example, the issues described above may be addressed by a fuel injector including at least one pulsation reducer arranged between a nozzle needle and a nozzle housing, the nozzle needle axially displaceable within the nozzle housing to close and open an outflow opening of a valve seat of the fuel injection nozzle, and at least one breakwater element on the at least one pulsation reducer, the at least one pulsation reducer including a sleeve that extends coaxially along the nozzle needle. The at least one breakwater element may extend into a space between the nozzle housing and the nozzle needle. Pulsations generated as fuel flows along the space towards the outflow opening of the fuel injector may be reduced by the at least one breakwater element without interfering with movement of the nozzle needle to open and close the outflow opening.

In this way, pulsations generated during a fuel injection process, particularly in the region of the valve seat, may be reduced by the above described breakwater elements of a pulsation reducer, thereby reducing fuel injection error due to excessive fuel pulsation near the valve seat of the fuel injector.

It should be pointed out that the features and measures individually listed in the following description can be combined with one another in any technically feasible manner and disclose further embodiments of the invention. The description characterizes and specifies the invention, particularly additionally in connection with the figures.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
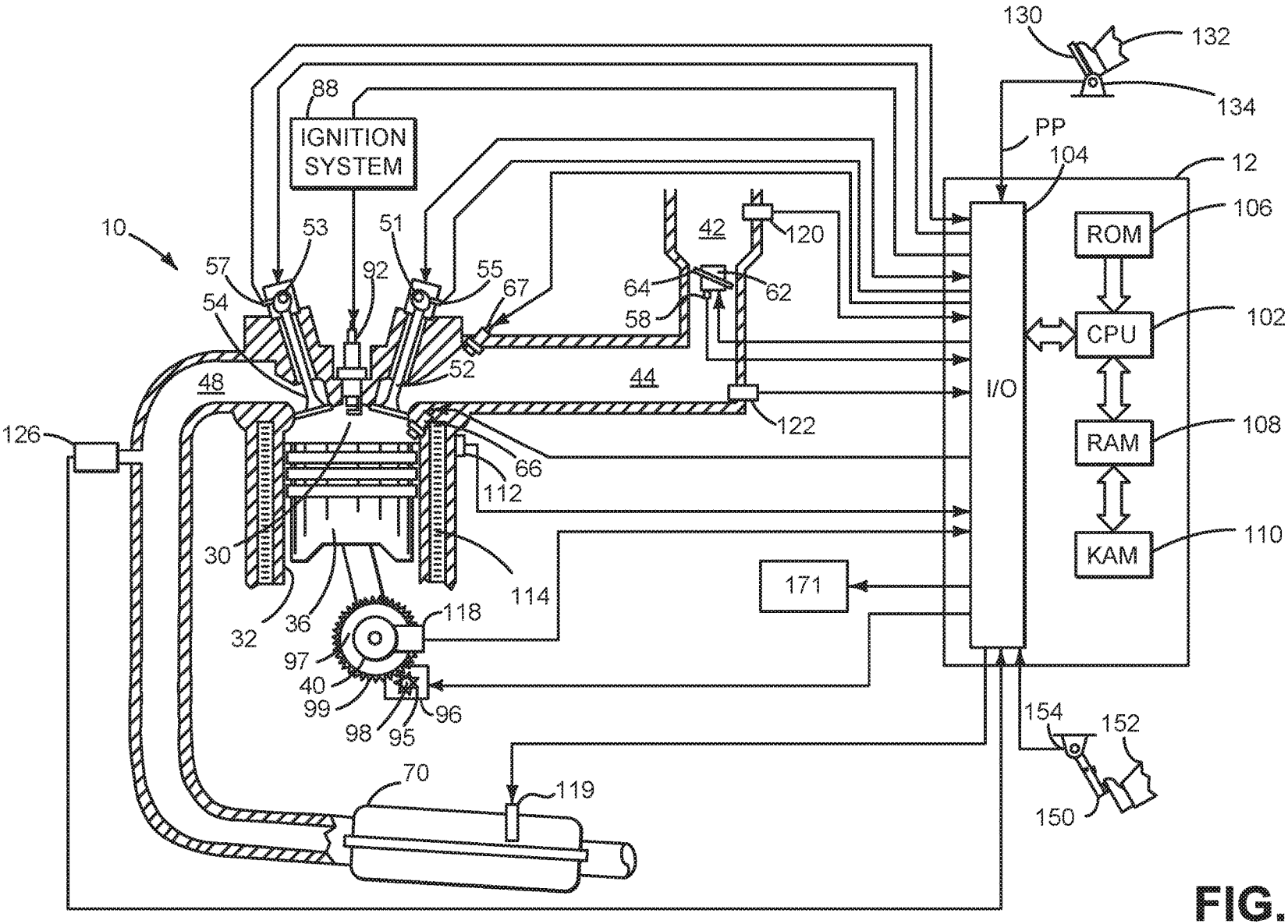
FIG. 1 shows an engine with a fuel injection system.
Figure 2:
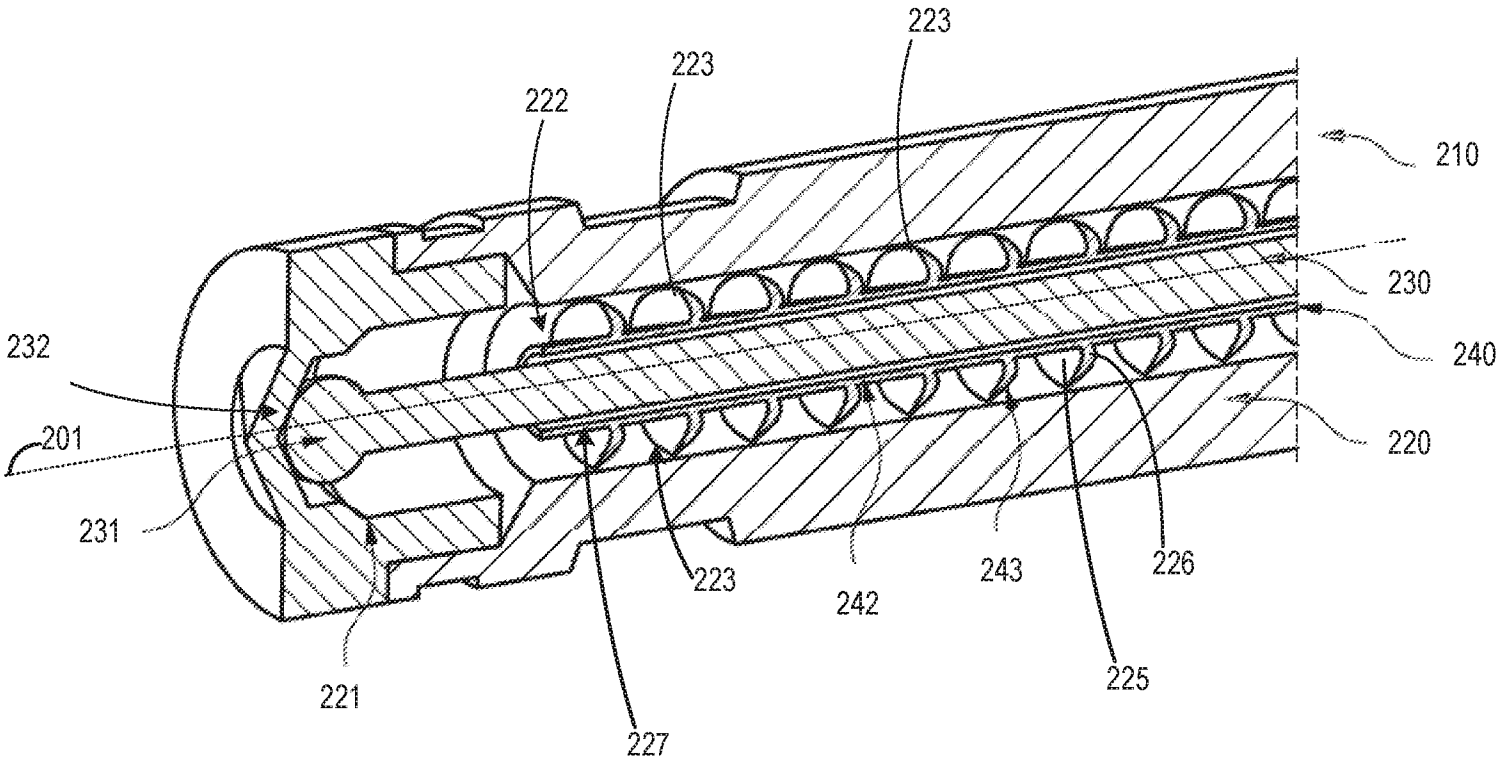
FIG. 2 shows a schematic representation of a first embodiment of a fuel injection nozzle with a pulsation reducer on the nozzle needle that can be moved together with the nozzle needle.
Figure 3:
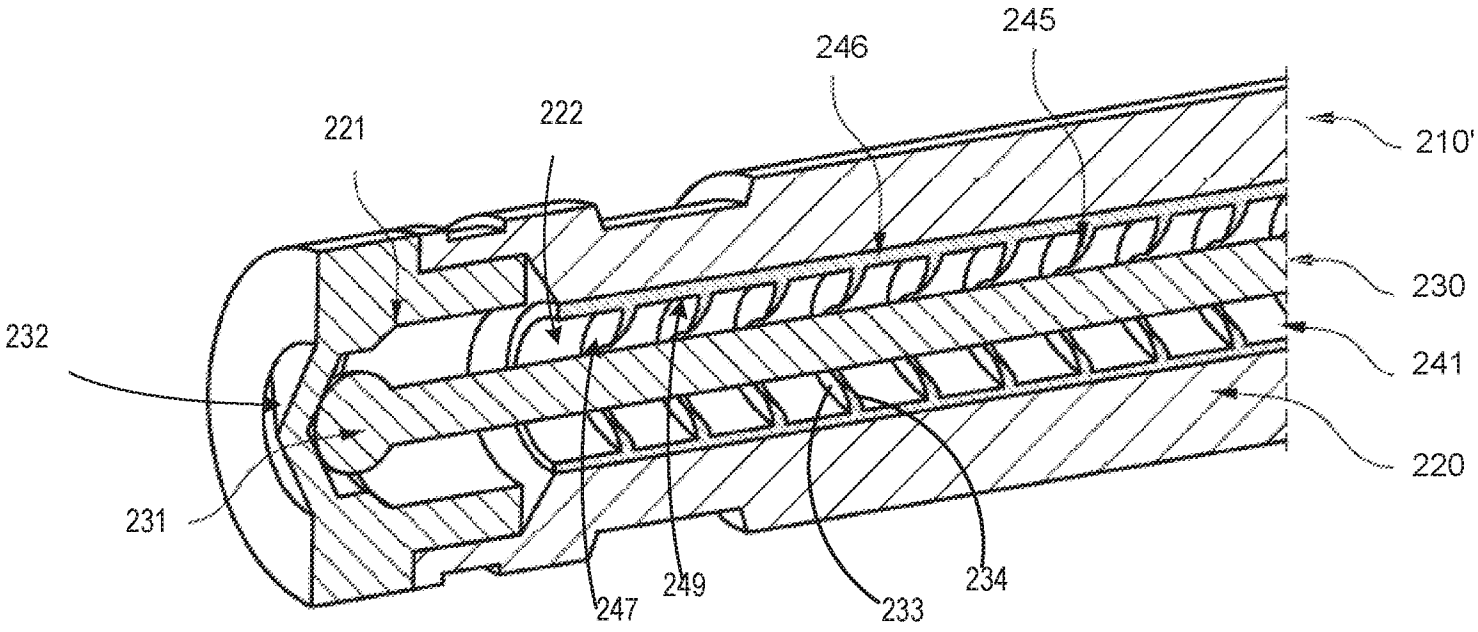
FIG. 3 shows a schematic representation of a second embodiment of a fuel injection nozzle with a fixed pulsation reducer on inside of the nozzle housing.
Figure 4:
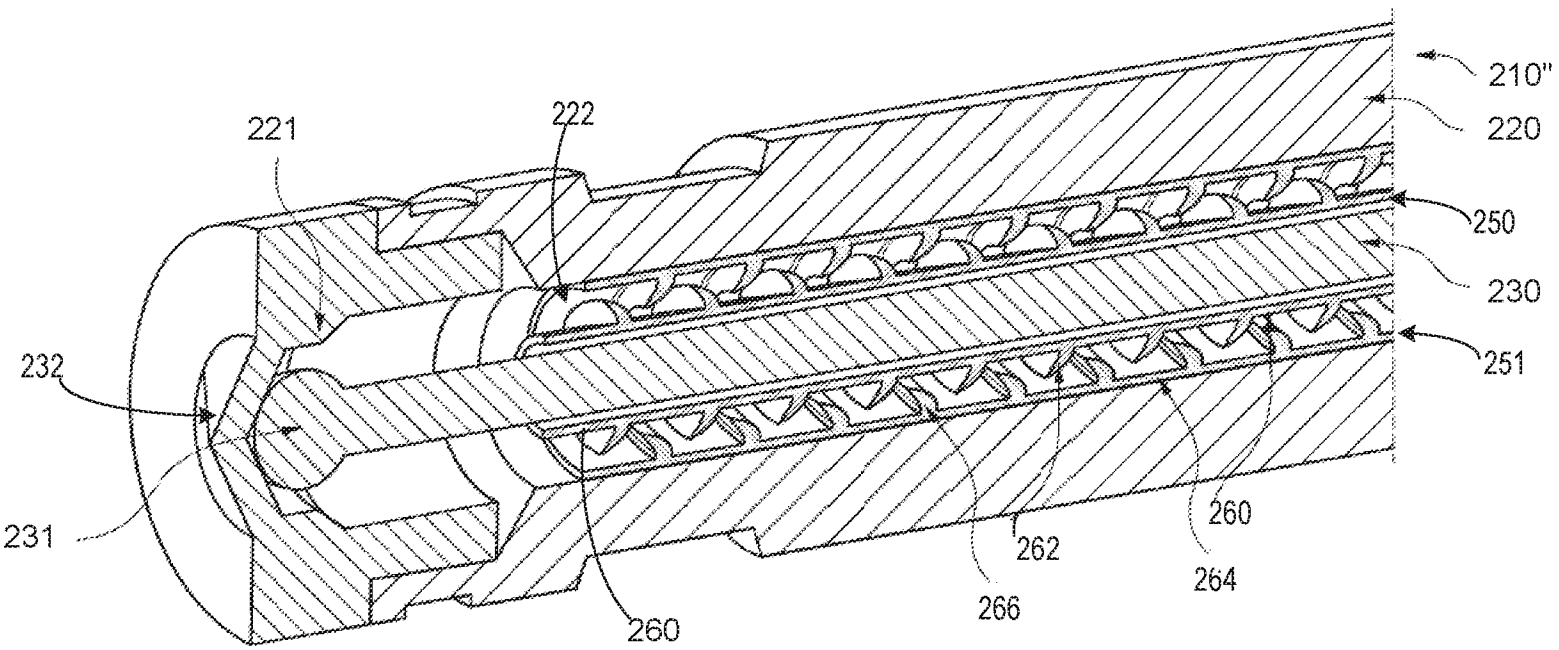
FIG. 4 shows a schematic representation of a third embodiment of a fuel injection nozzle.

The following description relates to systems and methods for a fuel injector nozzle of a fuel system of an engine, for example, the engine illustrated in FIG. 1. Pulsation noise produced while operating the fuel injector nozzle may be reduced by various damping mechanisms. FIGS. 2-4 show three different embodiments of a fuel injector nozzle that include a pulsation reducing mechanism to reduce pulsation noise while operating the fuel injector nozzle. The embodiments of the fuel injector nozzle illustrated in FIGS. 2-4 may be the fuel injector nozzles of the engine illustrated in FIG. 1. FIGS. 2-4 are drawn approximately to scale.

FIGS. 1-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a deactivated state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. A port fuel injector 67 is shown coupled to the intake manifold 44, which injects fuel upstream of the cylinder 30. Direct fuel injector 66 and port fuel injector 67 deliver liquid fuel in proportion to a voltage pulse width or fuel injector pulse width of a signal from controller 12. Fuel is delivered to the fuel injectors by a fuel system (not shown) including a fuel tank, fuel pump, and fuel rail (not shown). In addition, intake manifold 44 is shown communicating with optional electronic throttle 62, which adjusts a position of throttle plate 64 to control airflow from air intake 42 to intake manifold 44. Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

During operation, each cylinder within engine 10 typically undergoes a four-stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Fuel injection nozzle embodiments illustrated in FIGS. 2-4 may be used for a high-pressure fuel injection system and may be the direct fuel injector 66 and/or the port fuel injector 67, delivering fuel for combustion to the engine 10 of FIG. 1. In one example, a fuel injector nozzle may include a nozzle housing and a nozzle needle that is axially displaceable in the nozzle housing. The movement of the nozzle needle within the nozzle housing may regulate an outflow opening in a valve seat of the fuel injection nozzle (e.g., the outflow opening may be closed and opened). There is usually a gap/space present between an inside of the nozzle housing and the nozzle needle. At least one pulsation reducer may be present in the gap. The pulsation reducer may include a sleeve-shaped configuration and may extend coaxial to the nozzle needle, as will be described below with reference to FIGS. 2-4. The pulsation reducer also includes at least one element, which is configured as a breakwater providing interference along a liquid flow path without completely obstructing flow, and is referred to as a breakwater element.

The pulsation reducer dampens pressure pulsations in the fuel within the nozzle of the fuel injection nozzle. In this way, pressure fluctuations in the valve seat may be reduced. The at least one pulsation reducer thereby locally reduces a cross section within the nozzle housing through which fuel passes at one or more points. The pulsation reducer may be configured and arranged in different ways. For example, the pulsation reducer may be fixedly connected to the nozzle housing. The element may be formed integrally with the nozzle housing or it may be fixedly attached to the inside of the nozzle housing as a separate component. In another embodiment, the pulsation reducer may be fixedly connected to the nozzle needle, so that it moves with the nozzle needle.

The pulsation reducer may be a permanently installed or may be a movable pulsation reducer. In another example, a first pulsation reducer may be fixedly attached to the nozzle housing and a second pulsation reducer may be attached to the nozzle needle in such a manner that the first pulsation reducer and the second pulsation reducer together bring about a damping of pressure pulsations in the nozzle. Different geometries may be selected for the pulsation reducers in order to influence the fuel flow between the nozzle housing and the nozzle needle in such a manner that the pressure pulsations are dampened.

The at least one breakwater element of the pulsation reducer may be configured to reduce the cross section through which fuel flows locally within the nozzle housing. The at least one breakwater element may be formed as a scoop or blade that may be arranged accordingly along the fuel flow. The scoop or blade of the at least one breakwater element may point towards the valve seat of the fuel injection nozzle. In one example, the breakwater element may be arranged directly on the nozzle housing and/or the nozzle needle without a sleeve. The breakwater element may be produced integrally with the nozzle needle and/or the nozzle housing.

In one example, the pulsation reducer may include a plurality of breakwater elements. The plurality of breakwater elements may be spaced apart from one another in an axial direction, for example. In one embodiment, at least one pulsation reducer is formed by a hollow cylindrical main body, for example, to which at least one breakwater element of a plurality of breakwater elements is attached. The main body thereby forms a sleeve, from which one or more breakwater elements project. The sleeve-shaped main body may bear against the inside of the nozzle housing, wherein the breakwater elements project inwardly from the sleeve in the direction of the nozzle needle. A pulsation reducer on the nozzle needle may be surrounded by a sleeve, from which one or more breakwater elements project outwardly in the direction of the nozzle housing. When the two embodiments are combined, the breakwater elements of the two pulsation reducers are arranged in such a manner that they do not come into contact with one another when the nozzle needle moves. They may however mesh with one another in a comb-like fashion, wherein the movable breakwater elements of the nozzle needle move within the free spaces between the permanently standing breakwater elements on the nozzle housing.

In one embodiment, the at least one pulsation reducer is flexible, at least in sections, so that it may absorb energy from pressure waves in the fuel at least partially. Flexibility of the at least one pulsation reducer may be achieved through a corresponding choice of material and/or a suitable breakwater element geometry. For example, a pulsation reducer may be made of metal or a flexible material such as rubber, so that rubber elements or very thin metal plates can be used as breakwater elements. The main body may also be made of metal or of flexible material. In further example, different materials may be used for the sleeve and/or for the breakwater elements.

A first embodiment of a fuel injector nozzle 210, a second embodiment of a fuel injector nozzle 210', and a third embodiment of a fuel injector nozzle 210" are illustrated in FIGS. 2-4 respectively. The features of the injector nozzle previously introduced in FIG. 2 are numbered similarly and not reintroduced in FIGS. 3 and 4. An outflow end of the fuel injection nozzles 210, 210', and 210" includes an outflow opening 232 for fuel injection as shown in FIGS. 2-4. The fuel injection nozzles 210, 210', 210" may be the direct fuel injector 66 and/or the port injector 67 of FIG. 1. A controller, such as the controller 12 of FIG. 1 may be coupled to the fuel injection nozzles to regulate fuel injection.

The injection nozzles 210, 210', 210", each have a nozzle housing 220 and a nozzle needle 230 movably guided therein. The nozzle needle 230 may have a needle tip 231 in the form of a ball, for example, which closes the outflow opening 232 of the respective injection nozzle in a funnel-shaped valve seat 221. The nozzle needle 230 is axially movable within the nozzle housing 220, so that it can may close and open the outflow opening 232 alternately, in order to supply fuel in a cycled manner to an engine, for example the engine 10 of FIG. 1. The fuel is in turn supplied under high pressure to the injection nozzles 210, 210', and 210", by a fuel pump (not shown).

In the case of typical fuel injection nozzles, a space 222 or a radial slot 222 may be provided between the nozzle needle 230 and the nozzle housing 220, so that a pulsation reducer 240 (shown in FIG. 2) and a pulsation reducer 241

(shown in FIG. 3) may be arranged in the space 222 between the nozzle needle 230 and the inside of the nozzle housing 220.

In the embodiment in FIG. 2, the fuel injection nozzle 210 may include a movable pulsation reducer 240 that is configured as a sleeve 242 with a plurality of breakwater elements 243 attached thereto. The sleeve-shaped pulsation reducer 240 surrounds the nozzle needle 230 and moves together therewith within the nozzle housing 220. The breakwater elements 243 are configured as scoops, which project from the sleeve 242 into the space 222. In one example, the breakwater elements 243 project at an angle other than 90° relative to a longitudinal axis 201 of the injection nozzle 210, wherein they are tilted at a respective free end 223 of the breakwater elements, particularly in the direction of the valve seat 221. In another example, the breakwater elements 243 may be configured as scoops or may be configured as straight or bent small plates projecting into the space 222.

In one example, each of the breakwater elements 243 may include a first surface 225 and a second surface 226, opposite the first surface 225. The first surface 225 may face the valve seat 221 and the second surface 226 may face away from the valve seat 221. In one example, the first surface 225 may be concave towards the valve seat 221 consequently imparting a convex curvature to the second surface 226, the convex curvature facing away from the valve seat. In one example, the first surface 225 and the second surface 226 may not be curved.

In another example, the free end 223 of the breakwater element 243 may coaxially surround the injector needle without being in contact with the sleeve surrounding the injector needle 230. A base end 227 of the breakwater element opposite the free end 223 may be attached to the sleeve coaxially surrounding the injector needle without being in contact with the nozzle housing. The free end 223 may be closer to the nozzle housing 220 and the base end 227 may be closer to the nozzle needle.

The size and pattern of the breakwater elements 243 on the sleeve 242 are such that the fuel can still flow along the space 222 without obstruction to the outflow opening 232 in the valve seat 221. However, detrimental pressure pulsations in the fuel may be reduced by the shape and arrangement of the breakwater elements 243 projecting into the space 222. The movement of the nozzle needle 230 is not thereby affected by the pulsation reducer 240.

In the embodiment of the fuel injection nozzle 210' illustrated in FIG. 3, the pulsation reducer 241 is not attached to the nozzle needle 230, but to inside of the nozzle housing 220 (e.g., the pulsation reducer may be attached to an inner wall that defines the space 222). The second pulsation reducer 241 has a sleeve 246 with a plurality of scoop-shaped breakwater elements 245, which project inwardly from the sleeve 246 into the space 222. In one example, free ends 247 of the breakwater elements 245 are tilted in the direction of the valve seat 221.

In one example, each of the breakwater elements 245 may include a first surface 233 and a second surface 234, opposite the first surface 233. The first surface 233 may face the valve seat 221 and the second surface may face away from the valve seat 221. In one example, the first surface 233 may be concave towards the valve seat imparting a convex curvature to the second surface 234, where the convex curvature faces away from the valve seat 221. In one example, the first surface 233 and the second surface 234 may not be curved.

In another example, the free end 247 of the breakwater element 245 may coaxially surround the injector needle without being in contact with the sleeve 246 along inside of the injector needle housing. A base end 249 of the breakwater element 245 opposite the free end 247 may be attached to the sleeve 246 in contact with the nozzle housing. The free end 247 may be closer to the nozzle needle 230 and the base end 249 may be closer to the nozzle housing 220.

The size and pattern of the breakwater elements 245 on the sleeve 246 is such that the fuel can still flow along the space 222 without obstruction to the outflow opening 232 in the valve seat 221. However, detrimental pressure pulsations in the fuel are reduced by the shape and arrangement of the breakwater elements 245 projecting into the space 222. The movement of the nozzle needle 230 is not thereby affected by the pulsation reducer 241.

In the embodiment of the fuel injection nozzle 210" illustrated in FIG. 4, a first pulsation reducer 250 (similar to the pulsation reducer 240 illustrated in FIG. 2) is attached to the nozzle needle 230 and a second pulsation reducer 251 (similar to the pulsation reducer 241 illustrated in FIG. 3) is attached to the nozzle housing 220. The first pulsation reducer 250 includes a first sleeve 260 with a first set of breakwater elements 262. The first sleeve 260 may be attached to the nozzle needle 230 and the first set of breakwater elements 262 may project into the space 222. The second pulsation reducer 251 includes a second sleeve 264 attached to the nozzle housing 220 and a second set of breakwater elements 266 projects into the space 222.

The first set of breakwater elements 262 and second set of breakwater elements 266 may not be in contact with each other in the space 222 during the movement of the nozzle needle 230 and therefore, the nozzle needle 320 may still move freely within the nozzle housing 220.

In the embodiment of the fuel injector nozzle 210" illustrated in FIG. 4, the first set of breakwater elements 262 of the first pulsation reducer 250, and the second set of breakwater elements 266 of the second pulsation reducer 251 maybe arranged in such a manner that the first set of breakwater elements 262 on the first sleeve 260 attached to the nozzle needle 230 may move within the free spaces between the second set of breakwater elements 266 on the second sleeve 264 attached to the nozzle housing 220. In one example, the breakwater elements of each of the first and the second pulsation reducers, protruding into the space 222 may mesh with one another in a comb-like manner without coming into contact with one another during a movement of the nozzle needle 230. In another example, the first set of breakwater elements and the second set of breakwater elements may not mesh with one another, but may move freely alongside one another.

In one example, the breakwater elements of the pulsation reducers illustrated in FIGS. 2-4 may include a plurality of breakwater elements distributed uniformly along the respective sleeve and projecting into the space 222. In another example, the breakwater elements may be distributed along the respective sleeves non-uniformly, that is, isolated breakwater elements may be arranged at certain sections of the sleeve, while in other section no breakwater elements may be present.

The breakwater elements described above with reference to the FIGS. 2-4 may also be referred to as blades and may be spaced apart from one another in an axial direction and may be of continuous configuration as viewed in a peripheral direction of the sleeve. The breakwater elements may have the same spacing viewed in an axial direction, wherein the space between adjacent breakwater elements may be different in each case. A staggered arrangement is also possible, if the breakwater elements are provided in an interrupted manner when viewed in the peripheral direction.

In some examples, the axial space between successive breakwater elements in the axial direction may correspond to the stroke of the fuel injection nozzle, in other words to the stroke of the nozzle needle, wherein this may also apply to the staggered arrangement of the breakwater elements. In one example, the axial space between successive breakwater elements may be equal to or within a threshold range of the stroke of the nozzle needle. In an embodiment, the breakwater elements may exhibit an axial spacing from one another measuring 1 mm to 5 mm or even a spacing of less than 1 mm. In other examples, the breakwater elements may have an axial spacing of 0.3 to 0.5 mm, possibly even of 0.1 mm.

In this way, a plurality of breakwater elements of one or more pulsation reducers may project into a fuel passage of a fuel injector nozzle, which may reduce pulsations generated in the fuel as the fuel approaches an outflow opening on a valve seat of the fuel injector. The plurality of breakwater elements attached directly or indirectly (through a sleeve) to an injector needle and/or to an injector housing project into the fuel passage, and point towards the valve seat to reduce pulsations in the fuel flowing through the fuel passage without blocking fuel flow to an outlet of the fuel injector nozzle and without restricting movement of the nozzle needle during fuel injection.

The technical effect of reducing pulsations generated during a fuel injection process, particularly in the region of the valve seat, by the above described breakwater elements of one or more pulsation reducers includes reducing fuel injection error due to excessive fuel pulsation near the valve seat of the fuel injector.

An example fuel injection nozzle comprises at least one pulsation reducer arranged between a nozzle needle and a nozzle housing, the nozzle needle axially displaceable within the nozzle housing to close and open an outflow opening of a valve seat of the fuel injection nozzle, the at least one pulsation reducer including a sleeve that extends coaxially along the nozzle needle, and at least one breakwater element on the at least one pulsation reducer. In the preceding example, additionally or optionally, the at least one pulsation reducer is fixedly connected to the nozzle housing. In any or all of the preceding examples, additionally or optionally, the at least one pulsation reducer is fixedly connected to the nozzle needle. In any or all of the preceding examples, additionally or optionally, the at least one breakwater element locally reduces a cross section within the nozzle housing through which fuel passes. In any or all of the preceding examples, additionally or optionally, the at least one breakwater element includes a scoop pointing towards the valve seat of the fuel injection nozzle. In any or all of the preceding examples, additionally or optionally, the at least one breakwater element is attached to the sleeve. In any or all of the preceding examples, additionally or optionally, the at least one breakwater element includes a plurality of breakwater elements, each breakwater element of the plurality of breakwater elements spaced apart from one another in an axial direction on the sleeve. In any or all of the preceding examples, additionally or optionally, wherein the at least one pulsation reducer is flexible, at least in sections. In any or all of the preceding examples, additionally or optionally, the sleeve is made of a metallic non-flexible material. In any or all of the preceding examples, additionally or optionally, the least one breakwater element is made of the metallic non-flexible material. In any or all of the preceding examples, additionally or optionally, the sleeve is made of a non-metallic flexible material. In any or all of the preceding examples, additionally or optionally, the at least one breakwater element is made of the non-metallic flexible material.

An example fuel injection nozzle comprises a pulsation reducer mechanism coaxially positioned between a nozzle needle and a nozzle housing along a fuel passage of the fuel injection nozzle, the fuel passage fluidically connected to a fuel outlet at a valve seat of the fuel injection nozzle, and a plurality of breakwater elements arranged along a sleeve of the pulsation reducer mechanism, the plurality of breakwater elements projecting into the fuel passage. In the preceding example, additionally or optionally, the sleeve is attached to the injector needle. In any or all of the preceding examples, additionally or optionally, the sleeve is attached to an inside of the nozzle housing. In any or all of the preceding examples, additionally or optionally, each breakwater element of the plurality of breakwater elements includes a scoop pointing toward the valve seat. In any or all of the preceding examples, additionally or optionally, the fuel passage receives fuel from a high-pressure fuel rail system.

In any or all of the preceding examples, additionally or optionally, an axial space between successive breakwater elements of the plurality of breakwater elements is in an axial direction corresponding to a stroke of the nozzle needle.

Another example fuel injection nozzle comprises a first pulsation reducer including a first sleeve with a plurality of first breakwater elements, the first sleeve coaxially attached to an injection needle, the injection needle axially displaceable within a nozzle housing, the plurality of first breakwater elements projecting into a fuel passage along the injection needle, and a second pulsation reducer including a second sleeve with a plurality of second breakwater elements, the second sleeve attached to the nozzle housing, the plurality of second breakwater elements projecting into the fuel passage along the injector nozzle. In the preceding example, additionally or optionally, the injection needle is axially displaceable within the nozzle housing to fluidically connect the fuel passage via a fuel outlet of the fuel injection nozzle to a combustion chamber of an engine cylinder.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel injection nozzle comprising:

at least one pulsation reducer arranged between a nozzle needle and a nozzle housing, the nozzle needle axially displaceable within the nozzle housing to close and open an outflow opening of a valve seat of the fuel injection nozzle, the at least one pulsation reducer including a first sleeve that extends coaxially along the nozzle needle and which has an external cylindrically-shaped surface in face-sharing contact with the nozzle housing; and a first breakwater element arranged on the first sleeve with a first radial space between an outer end of the first breakwater element and a first portion of an inner surface of the first sleeve; and a second breakwater element arranged on a second sleeve, and the second breakwater element distinct from and longitudinally offset from the first breakwater element along a longitudinal axis parallel to an axis of the axially displaceable nozzle needle, with a second radial space between an outer end of the second breakwater element and a second portion of the inner surface of the first sleeve.

2. The fuel injection nozzle of claim 1, wherein the first sleeve is fixedly connected to the nozzle housing.

3. The fuel injection nozzle of claim 1, wherein the second sleeve is fixedly connected to the nozzle needle.

4. The fuel injection nozzle of claim 1, wherein the first and second breakwater elements each locally reduce a cross section within the nozzle housing through which fuel passes, the fuel also passing through the first and second radial spaces along the longitudinal axis, and wherein the inner surface is an inner cylindrically-shaped surface facing the nozzle needle and spaced away from the nozzle needle, the fuel injection nozzle including a third breakwater element on the at least one pulsation reducer with a third radial space between an outer end of the third breakwater element and the first portion of the inner surface of the first sleeve, the third breakwater element distinct from and spaced longitudinally from the second breakwater element along the longitudinal axis, the second breakwater element positioned longitudinally between the first and third breakwater elements, the inner surface extending longitudinally along the longitudinal axis and parallel to the longitudinal axis.

5. The fuel injection nozzle of claim 1, wherein the first breakwater element includes a first scoop pointing towards the valve seat of the fuel injection nozzle and the second breakwater element includes a second scoop pointing towards the valve seat of the fuel injection nozzle, wherein the first and second scoops are positioned equidistant from a central longitudinal axis of the nozzle needle, and wherein a plane formed by an outer edge of the first scoop is perpendicular to the longitudinal axis and a direction of axial motion of the nozzle needle.

6. The fuel injection nozzle of claim 4, wherein the first breakwater element extends radially from and is directly attached to the second portion of the inner surface, and the second breakwater element extends radially from and is directly attached to the first portion of the inner surface, the nozzle needle further comprising a fourth breakwater element on the at least one pulsation reducer with a fourth radial space between an outer end of the fourth breakwater element and the second portion of the inner surface of the first sleeve, the fourth breakwater element distinct from and spaced longitudinally from the third breakwater element along the longitudinal axis, the third breakwater element positioned longitudinally between the second and fourth breakwater elements, the first, second, third, and fourth breakwater elements longitudinally arranged in a pattern which alternates between extending inwardly and extending outwardly, respectively.

7. The fuel injection nozzle of claim 1, further comprising additional breakwater elements, each breakwater element of the first and second breakwater elements spaced apart from one another in an axial direction on the first sleeve, wherein a pattern of the breakwater elements on the first sleeve is such that fuel can still flow along a space, the space formed as a radial slot between the nozzle needle and the nozzle housing, without obstruction to the outflow opening in the valve seat, the outflow opening downstream of each and all breakwater elements.

8. The fuel injection nozzle of claim 1, wherein the at least one pulsation reducer flexes in response to pulsations within the fuel injection nozzle, at least in sections.

9. The fuel injection nozzle of claim 1, wherein the first sleeve is made of a metallic material.

10. The fuel injection nozzle of claim 9, wherein one or more of the first and second breakwater elements are made of the metallic material.

11. The fuel injection nozzle of claim 1, wherein the first sleeve is made of a non-metallic material that flexes in response to pulsations within the fuel injection nozzle.

12. The fuel injection nozzle of claim 11, wherein the first breakwater element is made of the non-metallic material.

13. A fuel injection nozzle, comprising:

a pulsation reducer mechanism coaxially positioned between a nozzle needle and a nozzle housing along a fuel passage of the fuel injection nozzle, the fuel passage fluidically connected to a fuel outlet at a valve seat of the fuel injection nozzle;

a first plurality of breakwater elements arranged along an interior of a first sleeve of the pulsation reducer mechanism and a second plurality of breakwater elements arranged along an exterior of a second sleeve of the pulsation reducer mechanism, each of the first and second pluralities of breakwater elements projecting into the fuel passage, an exterior surface of the first sleeve in face-sharing contact with an interior surface of the nozzle housing, the face-sharing surface cylindrical and sharing a central axis with an axis of the nozzle needle, the first and second pluralities of breakwater elements alternately positioned with alternate inwardly and then outwardly projecting scoops positioned along the interior of the first sleeve and the exterior of the second sleeve equidistant from the central axis, respectively; and the valve seat, the pulsation reducer mechanism positioned fully upstream of the valve seat, the pulsation reducer mechanism configured to reduce pressure pulsations caused by opening and closing of the fuel injection nozzle at the valve seat.

14. The fuel injection nozzle of claim 13, wherein the second sleeve is attached to an injector needle.

15. The fuel injection nozzle of claim 13, wherein the first sleeve is attached to an inside of the nozzle housing.

16. The fuel injection nozzle of claim 13, wherein each breakwater element of the first and second pluralities of breakwater elements includes a scoop pointing toward the valve seat.

17. The fuel injection nozzle of claim 13, wherein the fuel passage receives fuel from a high-pressure fuel rail system.

18. The fuel injection nozzle of claim 13, wherein a distance of an axial space between successive breakwater elements of one or more of the pluralities of breakwater elements corresponds to a stroke of the nozzle needle.

19. A fuel injection nozzle, comprising:

a first pulsation reducer including a first sleeve with a plurality of first breakwater elements, the first sleeve coaxially attached to an injection needle, the injection needle axially displaceable within a nozzle housing, the plurality of first breakwater elements projecting into a fuel passage along the injection needle;

a second pulsation reducer including a second sleeve with a plurality of second breakwater elements, the second sleeve attached to the nozzle housing, the plurality of second breakwater elements projecting into the fuel passage along the fuel injection nozzle, the pluralities of first and second breakwater elements positioned fully between the first and second sleeves and further alternately positioned along a longitudinal axis of the injection needle; and a valve seat, the first and second pulsation reducers each positioned fully upstream of the valve seat, the pulsation reducers configured to reduce pressure pulsations caused by opening and closing of the fuel injection nozzle at the valve seat.

20. The fuel injection nozzle of claim 19, wherein the injection needle is axially displaceable within the nozzle housing to fluidically connect the fuel passage via a fuel outlet of the fuel injection nozzle to a combustion chamber of an engine cylinder.

* * * * *